US005655445A

United States Patent [19]

Brocker et al.

[11] Patent Number: 5,655,445

[45] Date of Patent: Aug. 12, 1997

[54] CARRIER FOR A SCREEN PRINTING STENCIL

[75] Inventors: Hans Brocker; Fridolin Scherrer; Martin Lehner, all of St. Gallen, Switzerland

[73] Assignee: Gallus Ferd Ruesch AG, Switzerland

[21] Appl. No.: 551,793

[22] Filed: Nov. 7, 1995

[30] Foreign Application Priority Data

Nov. 8, 1994 [CH] Switzerland ..... 3336/94

[51] Int. Cl.[6] ..... B05C 17/06

[52] U.S. Cl. ..... 101/127; 101/116; 101/127.1

[58] Field of Search ..... 101/127.1, 127, 101/116, 128, 128.1; 33/614, 616, 623, 647

[56] References Cited

U.S. PATENT DOCUMENTS 4,098,184 7/1978 Okada et al. ..... 101/41

4,381,706 5/1983 Harpold ..... 101/127.1

*Primary Examiner*—Edgar S. Burr

*Assistant Examiner*—Dave A. Ghatt

*Attorney, Agent, or Firm*—Laurence R. Brown

[57] ABSTRACT

The carrier of the screen printing stencil is mounted onto an auxiliary frame which holds the entire structure stable in the shape of a plate. Due to specific design of the longitudinal profile bars of the frame as bendible metal profile bars which return on their own into the outstretched shape, made e.g. of a springy sheet metal, a cylinder can be shaped from the relatively stable plate at any time.

7 Claims, 1 Drawing Sheet

CARRIER FOR A SCREEN PRINTING STENCIL

BACKGROUND OF THE INVENTION

1. Field of the Invention

The present invention relates to a carrier for a screen printing stencil having the shape of a square planar structure with a coating consisting at least in predetermined areas of a photo-sensitive coating.

2. Description of the Prior Art

For the production of rotary screen printing cylinders basically two systems are presently available, namely:

a) endless cylinders, of which the basic structure, i.e. the stencil carrier proper is manufactured as a cylinder. The further processing to a stencil suitable for printing takes place at the cylinder itself. The sequence of operations is relatively intrinsic and the equipment needed thereto are to be made to suit the prevailing diameters and lengths of the respective cylinders. By means of these cylinders i is possible to produce so-called "endless" prints.

b) Finite cylinders, of which the basic structure, i.e. the stencil carrier proper is produced as a planar material in the form of a web or sheet. Here, the further processing proceeds in the planar state. And, as final production step prior to the printing the shaping to a printing cylinder takes place which necessitates relatively costly and accurate production steps. The devices for the processing are practically independent from the format because the diameters and the lengths of the cylinders have a limited influence only.

These cylinders display always a interruption due to the seam of the cylinder. However, they allow the low cost printing by means of cylinder segments because a relatively expensive stencil is necessary at the printing area only (the remaining surface of the cylinder can be formed e.g. by a low cost foil).

The present stencils of this kind are utilize practically exclusively as so called one way stencils, with printing lengths up to about 650 millimeters and printing widths up to about 400 millimeters.

The practical experiences made with conventional stencils have revealed that a handling of larger formats is hardly possible. A forming of cylinders in the printing plant itself and a re-use of the stencil is practically impossible.

SUMMARY OF THE INVENTION

Hence, it is a general object of the present invention to provide a carrier for a screen printing stencil which is suitable also for a forming of screen printing cylinders with large printing lengths (more than 1000 millimeters) and large printing widths (more than 700 millimeters). The actual production of the stencil shall, thereby, proceed in a planar state and the reusability of the stencil carrier shall be ensured.

A further object is to provide a carrier for a screen printing stencil having an auxiliary frame consisting of two longitudinal profile bars and two rigid lateral profile bars interconnecting the two longitudinal profile bars, onto which auxiliary frame the stencil carrier is mounted forming a screen printing plate, which longitudinal profile bars consist of an elastic material and feature a cross-section of a design which allows the bars to be bent out of their planar shape in a spring elastic manner by a force applied from the outside in order to deform the screen printing plate to at least a part of a cylinder, but to return upon a removing of the force applied from the outside automatically into their initial planar state.

Due to the auxiliary frame applied in accordance with the invention a production of stencils without any wrinkling or faults is possible also in large formats. Furthermore, a simple forming of the cylinder and a forming without folds directly in the printing plant is guaranteed without any problems and a repeated use of the stencil for printing is ensured.

At the other hand, the planar screen printing plate, formed of the stencil carrier proper and the auxiliary frame connected thereto can be shaped to a cylinder and set onto the cylinder hubs in the printing plant itself due to the specific design of the longitudinal profile bars of the frame without the stencil carrier, due to the closed auxiliary frame, getting wrinkled or otherwise deformed.

This is made possible because the bending strength of the longitudinal profile bars is limited (sufficient for a normal stiffness of the flat plate, but bendible by a normal expenditure of force from the outside). The fastening of the stencil carrier proper onto the longitudinal profile bars of the frame, e.g. by an adhesive, should be made in the zone of the neutral bending point of the profile bar.

The frame profile bars, specifically the longitudinal profile bars are formed commonly by metal webs (springy sheet metal) and comprise a specific cross section (similar to the arcade lamella of venetian blinds) which ensures a sufficient stability of the frame in its planar state but allows a deforming (forming of the cylinder) by a slight influence of force from the outside (after passing the respective "buckling point").

Specific embodiments of the stencil carrier structured in accordance with the invention are defined in the dependent claims.

Thus, in accordance with a further object of the invention, the lateral profile bars of the frame form a snap closure mechanism (e.g. Z-profile) which allow together with a locking ledge the forming of closed cylinder. Due to this design these lateral profile bars obtain a maximal bending strength at a minimal thickness of the sheet metal.

Because the screen printing stencil is present outside of the printing plant in form of a planar plate, it is a further object of the invention to provide a carrier for a screen printing stencil which allows a working prior to and after the printing operation by devices and apparatuses which are common in the field of planar screen printing (no custom made devices necessary).

Still a further object is to provide a carrier for a screen printing stencil in which the respective profile bars of the frame are interconnected by welding.

Yet a further object is to provide a carrier for a screen printing stencil in which the connecting of the stencil carrier (weaving of a plastic material or of a metal or a perforated foil with a photosensitive coating placed thereon) to the auxiliary carrier proceeds preferably by a bonding agent or by welding.

Due to the design of the stencil carrier (auxiliary frame) in accordance with the invention it is possible to produce screen printing plates of large shapes and practically any dimensions and to use them as screen printing cylinders in the field of the rotation screen printing. Thereby, the dimensions of the longitudinal and lateral profile bars of the auxiliary frame can be made to suit the respective demands.

The stencil carrier structured in accordance with the invention, which is suitable for forming printing cylinders could obviously be operated in the planar state, i.e. as screen printing plate.

The base stencil carrier in form of a rectangular planar structure consists generally of a stabilized weaving or of a foil, pre-perforated e.g. as galvanic stencil or after-perforated, e.g. etched or treated by a laser.

BRIEF DESCRIPTION OF THE DRAWINGS

The present invention will be better understood and objects other than those set forth above will be come apparent when consideration is given to the following detailed description thereof. Such description makes reference to the annexed drawings, wherein.

DESCRIPTION OF THE PREFERRED EMBODIMENT

Figure 1:
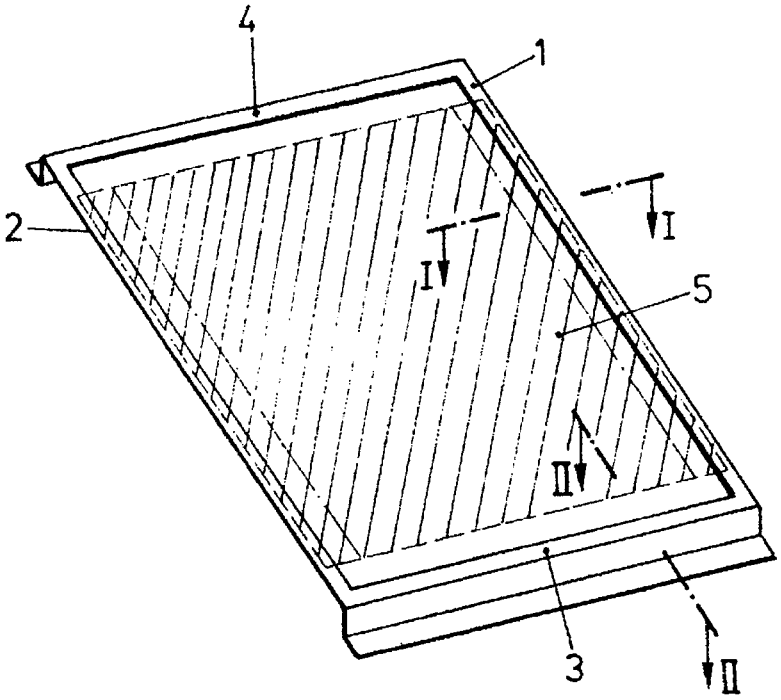
FIG. 1 is a perspective view of a carrier for a screen printing stencil equipped with an auxiliary frame in accordance with the invention.
Figure 2:
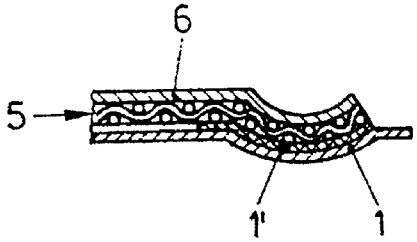
FIG. 2 is a section along line I—I through a longitudinal frame profile bar with a stencil carrier mounted thereon.

FIG. 1 of the drawing illustrates schematically an auxiliary frame, consisting of two longitudinal profile bars 1,2 and two lateral profile bars 3,4 welded thereto. In its planar, flat state this auxiliary frame is relatively stable, i.e. also when being manipulated it will remain in the planar plate shape. Such as also specifically illustrated by FIG. 2 a stencil carrier 5 having the shape of a stabilized weaving, specifically a weaving of a metal or a perforated foil and having a photosensitive layer 6 placed thereon at least at certain areas, is mounted (e.g. by a bonding agent) at both sides onto the longitudinal profile bars 1,2 of the auxiliary frame. The special matter of the entire structure is not only the auxiliary frame on its own, but the design of the longitudinal profile bars 1,2: They feature a cross-section in form of arcuate sheet metal lamellas which can be bent by an influence of an external force outside such that in a most simple way a printing cylinder can be formed out of the screen printing stencil carrier equipped with the auxiliary frame.

Figure 3:
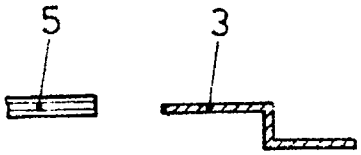
FIG. 3 is a section through a frame cross profile.
Figure 4:
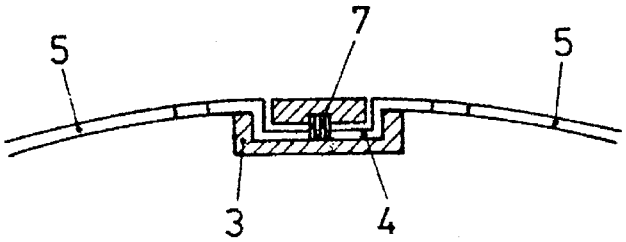
FIG. 4 illustrates schematically a cylinder closing lock.

In order to close the cylinder jacket, the lateral profile bars are designed preferably to form together with a locking ledge 7 a snap fastener (see FIG. 3 and 4).

As soon as the external forces do no longer act onto the arcuate stencil carrier with auxiliary frame it returns on its own again into the planar plate shape.

The mounting of the stencil carrier (weaving 5,6) to the longitudinal profile bars 1,2 proceeds preferably in the area of the neutral zone of latter (no influences when bending). By use of a suitable bonding agent the location of the mounting is, however, not critical.

The connecting ledge for the lateral profiles 3,4 can also be slid on from the side.

The Screen printing cylinder can be assembled in the printing plant itself, this by a placing of the bending stencil carrier onto lateral supporting discs (hubs) for the cylinder.

The large advantage of the screen printing stencil in accordance with the invention is that all processing steps (among others the manufacturing of the stencil or printing pattern, resp. itself; processing for re-use, etc.) can be performed in the planar state and that the shaping to a cylinder can proceed in a most simple manner in the printing plant itself.

While there is shown and described a present preferred embodiment of the invention, it is to be distinctly understood that the invention is not limited thereto, but may be variously embodied and practiced within the scope of the following claims.

We claim:

1. In a screen printing plate providing a printing stencil affixed within a surrounding rectangular shaped frame having rigid lateral end bars and spring elastic longitudinal side bars, the improvement comprising in combination:

closure means provided on the lateral end bars for fastening said lateral end bars together when the side bars are elastically bent into a screen printing cylindrical configuration structured to form a printing plate removably carried by hubs for rotation of the printing plate as a screen printing cylinder.

2. The improved screen printing plate of claim 1 further comprising rectangular printing stencils of printing lengths more than 1,000 millimeters and printing widths of more than 700 millimeters.

3. The improved screen printing plate of claim 1 wherein said spring elastic longitudinal side bars further comprise specific cross section configuration means for ensuring stability of the width of said rectangular shaped frame in both a planar flat state and when in said cylindrical configuration for printing.

4. The improved screen printing plate of claim 1 wherein the printing stencil comprises a perforated member with a photosensitive coating.

5. In a screen printing plate providing a printing stencil affixed within a surrounding rectangular frame having rigid lateral end bars and spring elastic longitudinal side bars adapting the screen printing plate when subjected to external forces to be elastically deformed from a planar shape into a cylindrical printing surface, the improvement comprising in combination, said longitudinal side bars being connected to said end bars and comprising mating arcuate shaped sheet metal lamellas having borders of the printing stencil affixed between the side bars, and means for connecting the end bars to form a substantial cylindrical configuration.

6. The improved screen printing plate of claim 5 wherein said lamellas of the longitudinal side bars are comprised of a springy sheet metal biased to retain the printing plate in a stable planar state subject to deformation into said cylindrical printing surface by application of external bending forces.

7. The improved screen printing plate of claim 5 wherein the printing stencil comprises a perforated member with a photosensitive coating.

* * * * *